United States Patent [19]

Dantlgraber et al.

[11] Patent Number: 4,780,069

[45] Date of Patent: Oct. 25, 1988

[54] DIRECTLLY ACTUATED VANE-TYPE PUMP

[75] Inventors: Jörg Dantlgraber, Lohr-Sackenbach; Josef Büdel, Wiesthal; Horst Fischer, Lohr/Main; Karl Staub, Frammersbach; Albert Müller, Aschaffenburg, all of Fed. Rep. of Germany

[73] Assignee: Mannesmann Rexroth GmbH, Lohr, Fed. Rep. of Germany

[21] Appl. No.: 53,594

[22] Filed: May 20, 1987

Related U.S. Application Data

[63] Continuation of Ser. No. 765,492, Aug. 14, 1985, abandoned.

[30] Foreign Application Priority Data

Aug. 14, 1984 [DE] Fed. Rep. of Germany ..... 3429935

[51] Int. Cl.[4] ..... F04C 2/344; F04C 15/04

[52] U.S. Cl. ..... 418/26; 418/27; 418/30; 418/31

[58] Field of Search ..... 418/24–27, 418/31, 105, 251, 26, 27, 30; 417/220

[56] References Cited

U.S. PATENT DOCUMENTS

| | | | |
|---|---|---|---|
| 2,026,776 | 1/1936 | Douglas | 418/26 |
| 2,600,632 | 6/1952 | French | 418/26 |
| 2,612,114 | 9/1952 | Ernst | 418/26 |
| 2,740,256 | 4/1956 | O'Malley | 418/26 |
| 2,975,717 | 3/1961 | Rynders | 418/26 |
| 3,010,545 | 11/1961 | Young | 418/26 |
| 3,015,212 | 1/1962 | Krafft | 418/26 |
| 3,373,692 | 3/1968 | Klessig | 418/27 |
| 3,451,344 | 6/1969 | Trick | 418/27 |
| 3,687,579 | 8/1972 | Martin | 418/26 |
| 3,728,048 | 4/1973 | Ratliff | 418/27 |
| 4,035,105 | 7/1977 | Dantlgraber | 418/26 |
| 4,259,039 | 3/1981 | Arnold | 418/26 |
| 4,325,215 | 4/1982 | Yamamoto | 418/26 |

FOREIGN PATENT DOCUMENTS

| | | | |
|---|---|---|---|
| 3302547 | 7/1984 | Fed. Rep. of Germany | 418/26 |

*Primary Examiner*—John J. Vrablik

*Attorney, Agent, or Firm*—Cushman, Darby & Cushman

[57] ABSTRACT

In general terms the invention provides for a direct actuated pressure regulated vane-type pump having a adjustment piston which is under the influence of the pump pressure. The adjustment piston is coupled to said cam ring by means of a flexible or articulate connection means, or else the adjustment piston itself is of a flexible or articulate design.

19 Claims, 8 Drawing Sheets

101
24
6
33
7
4
11
2
14
1
15
25
22
5
3
17

101
1
6
6a
35
40
9
8
42
2
14
13
15
41
10
7

DIRECTLLY ACTUATED VANE-TYPE PUMP

This is a continuation of application Ser. No. 765,492, filed Aug. 14, 1985, which was abandoned upon the filing hereof.

The invention relates to a directly actuated pressure regulated vane-type pump comprising a housing within which a cam ring is arranged. Inside said cam ring a rotor is rotatably mounted and carries a plurality of vanes. Spring means acting between the housing and the cam ring tend to bias the cam ring into an initial position which is excentric with respect to the rotor.

Directly actuated pressure regulated vane-type pumps are already known and are disclosed for example in the following publication: "The Hydraulic Trainer", published by G. L. Rexroth GmbH in 1981; see pages 42 and 43. The expression "directly actuated" is intended to point out that such pumps do not use control means and hydraulic pistons operated by said control means. Direct actuated pressure regulated vane-type pumps use, as already mentioned, spring means which act upon the cam ring. Generally, diametrically opposite to the point where the spring means act on the cam ring adjustable screw means are provided by means of which the maximum value of excentricity can be adjusted and consequently the maximum volume to be displaced. Typically, said spring means may be varied by means of an adjustment screw.

A pump of the type set forth above typically includes two passages or ports, an arcuately shaped fluid inlet port and an arcuately shaped fluid outlet port. Said two ports form a so-called porting image, i.e. a relative arrangement of the inlet port with respect to the outlet port. For a pump of the type set forth above the pressure which builds up due to the working resistence (e.g. at the user, a cylinder with load) affects the internal running surface of the cam ring on the pressure side. This results in a horizontal force component which operates against said spring means.

So as to optimize the noise level the angle between the horizontal component and the entire force exerted upon the cam ring is approximately 90° so that the said horizontal component is relatively small. A consequence of this situation is that only a small change of the horizontal component will occur when the system or pump pressure changes. Therefore, only a small acceleration of the cam ring will be achieved with the consequence of obtaining only a low speed of adjustment.

It should be noted further that there exists a disturbing force which acts upon the cam ring in the same but opposite direction as does said horizontal component. Said disturbing force is primarily determined by the pre-compression in the area of change over of the pump. In fact, the disturbing force is generated by the pressure which exists in the change over chamber, i.e. the chamber formed between the two vanes which move in the area between the inlet port and the outlet port. This chamber, which is typically only one chamber, is also called the change-over chamber. It should be noted, that said disturbing force increases when said horizontal component decreases. Said disturbing force (or force of disturbance) is not proportional to the pressure so that for an increase of the influence of the force of disturbance with respect to said horizontal component the decrease characteristic of the pump (the amount of pressure medium, e.g. oil supplied by the pump depending on the pressure) is influenced in an undesirable manner. Said disturbing force causes a bending of the characteristic so that an overcontrol of the pump (one pressure value corresponds to two or more Q-values) and therefore an instability is created.

It is an object of the present invention to provide a pump of the type set forth above such that a low noise operation is achieved. It is another object of the invention to avoid one or more of the disadvantages set forth above.

In accordance with the present invention a direct actuated pressure regulated vane-type pump is provided having a housing within which a cam ring is arranged. A rotor supporting a plurality of vanes is rotatably mounted within said cam ring. Spring means acting between the housing and the cam ring tend to push the cam ring into an excentric initial position. An adjustment piston is provided which exerts a force onto the cam ring, a force which acts diametrically against the force of said spring means. The adjustment piston is under the influence of the pump or system pressure. The inlet port and the outlet port of the pump being arranged such that the force exerted by the system pressure onto the internal running surfaces of the cam ring forms an angle $\alpha$ of close to 90° with its horizontal component which acts against said spring means. Further, the force exerted by the spring means is substantially larger than a disturbing force which is mainly generated and determined by the pre-compression in the area of change over. Said disturbing force being generated by the pressure which exists in the change-over chamber (i.e. the chamber being defined by two vanes) which is moving from the end of the inlet port to the beginning of the outlet port.

In accordance with a preferred embodiment of the invention the force exerted by the spring means is selected such that it is in the area of about 30 to 70 times the disturbing force. In accordance with another preferred embodiment of the invention the adjustment piston is located in the housing and defines a pressure space or chamber, a pressure space which is connected with the system pressure.

So as to provide for a low friction transfer of the force of the adjustment piston to the cam ring an intermediate member is provided between the piston as such and the cam ring. The intermediate member provides for a flexible connection. In accordance with another preferred embodiment the cam ring is secured against rotation by means of a locking means. Preferably, the intermediate member is always under tension by means of spring means.

In accordance with another preferred embodiment of the invention the point where the first mentioned spring means act on the cam ring is not diametrically opposite to the point where the adjustment piston acts on the cam ring, but said two points are offset by a distance with respect to each other.

In accordance with another embodiment of the invention a hydrostatic pressure field may be provided between the adjustment piston and the cam ring so as to reduce the friction.

With the above and other objects in view, as will hereinafter appear, the invention comprises the device, combinations, and arrangements of parts, hereinafter set forth and illustrated in the accompanying drawings of a preferred embodiment of the invention in which the several features of the invention and the advantages obtained thereby will be readily understood by those skilled in the art.

Figure 1:
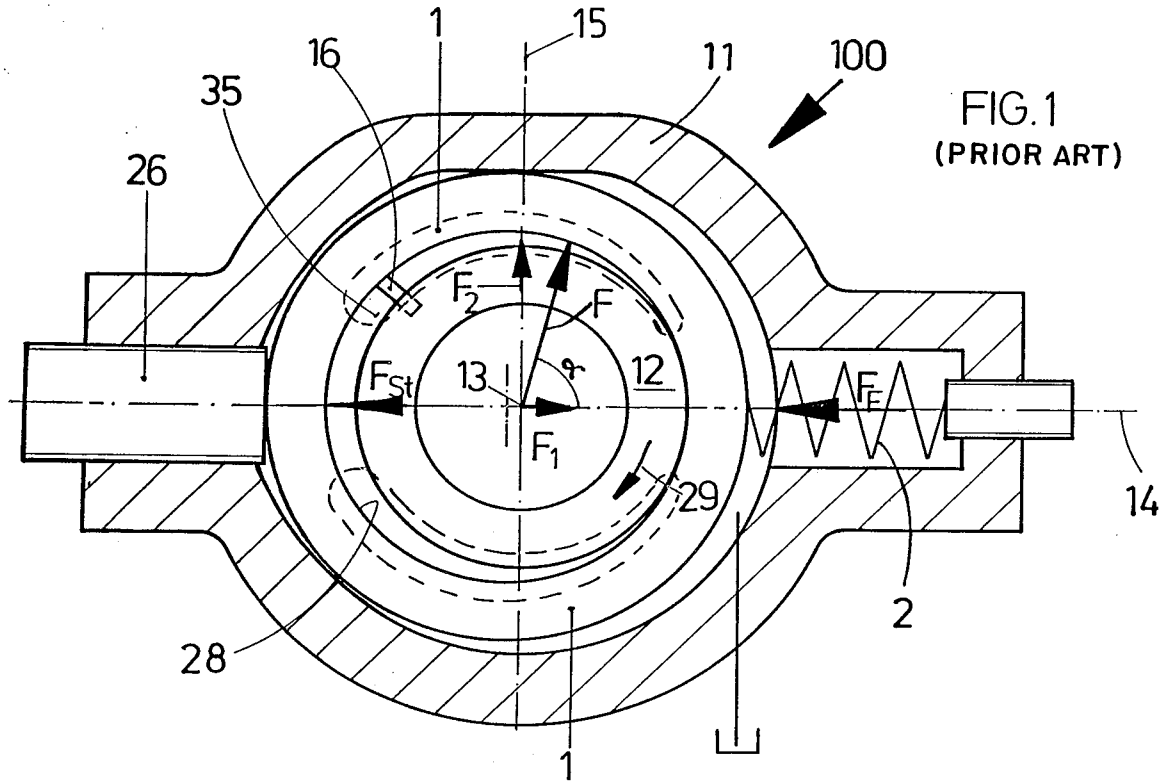
FIG. 1 (PRIOR ART)
FIG. 1 represents a schematic cross sectional view of a directly operated pressure regulated vane-type pump of the prior art.

FIG. 1 shows schematically a cross sectional view of a directly actuated pressure regulated vane-type pump 100 of the prior art. A pump of this type is shown and described in detail in: "The Hydraulic Trainer", Instruction and Information on Oil Hydraulics, published by G. L. Rexroth GmbH, Lohr am Main, W-Germany, 1981; see specifically pages 42 and 43.

Said known pump 100 comprises a housing 11 within which a cam ring 1 is supported. Within said cam ring a rotor 12 is rotatably mounted. Said rotor 12 carries a plurality of vanes 16 (only one of which is shown) which form together with the internal running surface 28 of the cam ring 1 a plurality of chambers. During operaton of the pump said vanes are maintained in contact with said internal running surface. As is well known, the rotor 12 is mounted on a shaft so as to provide for a rotary movement of the rotor 12 within said cam ring 1. The direction of rotation of the rotor 12 is shown in FIG. 1 by an arrow 29. As is also well known, the pump 100 is provided with an inlet port and an outlet port defining within said pump a suction area and a pressure area, respectively. Reference numeral 35 designates in FIG. 1 the approximate location of the pressure area.

FIG. 1 further shows the longitudinal axis 13 of the pump which extends in the direction of the axis of the rotor 12. In addition, all Figures, not only FIG. 1, show the two cross axes 14 and 15, respectively, which are perpendicular to each other.

Spring means in the form of a coil spring 2 act between the housing and the cam ring 1 and tend to push the cam ring 1 against a screw 26 which is arranged in a well known manner in said housing 11 opposite to said spring means 2. The above mentioned cross axis 14 could therefore be called the spring means axis and the cross axis 15 could be called the height support axis inasmuch as the housing 11 provides support for the cam ring in upward direction in the area of said cross axis 15.

When operating the pump, pressure will build up due to the working resistance and will act on the internal running surface of the cam ring 1 on the pressure side or in the pressure area 35 of the pump. This pressure creates a force which is designated F in FIG. 1 and also in the other Figures. The horizontal component of said force F is designated $F_1$ and the vertical component is designated $F_2$. The angle between F and $F_1$ is called $\alpha$.

As mentioned above pump 100 of FIG. 1 (as well as the embodiments of pumps shown in FIGS. 2 to 8) comprises a pair of oppositly arranged ports, an inlet port and an outlet port, respectively. Only FIG. 2 yet to be described shows schematically said inlet and outlet ports which are designated in said FIG. 2 by reference numerals 150 for the inlet port and 151 for the outlet port. Inlet port and outlet port define what is called in the art a porting image which for instance can be changed depending on the circumferential length of each of said ports.

For reasons of obtaining an optimum noise level the above mentioned angle $\alpha$ of the pump 100 (as well as of the pumps of the invention yet to be described) is close to 90°. It should be noted that said angle $\alpha$ depends on said porting image. Because the angle $\alpha$ is arranged to be close to 90°, the horizontal component $F_1$ of the force F which depends on the pressure will be relatively small. In this context it should be noted that the force exerted by the spring means 2 onto the cam ring 1 is designated $F_F$.

In addition to the above mentioned forces another force is present, a force which is called a force of disturbance or disturbing force $F_{St}$. Said disturbing force $F_{St}$ is primarily generated and determined by the pre-compression in the area of change over, i.e. the area between the end of the inlet port and the beginning of the outlet port, an area within which typically one pressure chamber may be located. As is well known in the art force, $F_{St}$ is generated by the compression of oil in the pressure chamber(s) as the rotor rotates within the cam ring. More particularly, as the rotor rotates, a pressure chamber passing through the area of changeover will be silghtly reduced in volume. The oil within the chamber being relatively non-compressible, will resist this volume reduction or compression force, thereby generating a force $F_{St}$. The force $F_{St}$ will have an increasing influence with a decreasing horizontal component $F_1$. Further, disturbing force $F_{ST}$ is not proportional to the pressure of the system, rather, force $F_{ST}$ is related to the change in volume of the pressure chamber, the material within the pressure chamber, the speed of the rotor, etc. As a consequence thereof, the flow (Q) vs. system pressure relationship or decrease characteristic of the pump in undesirably affected when the influence of $F_{St}$ increases with respect to $F_1$.

Figure 2:
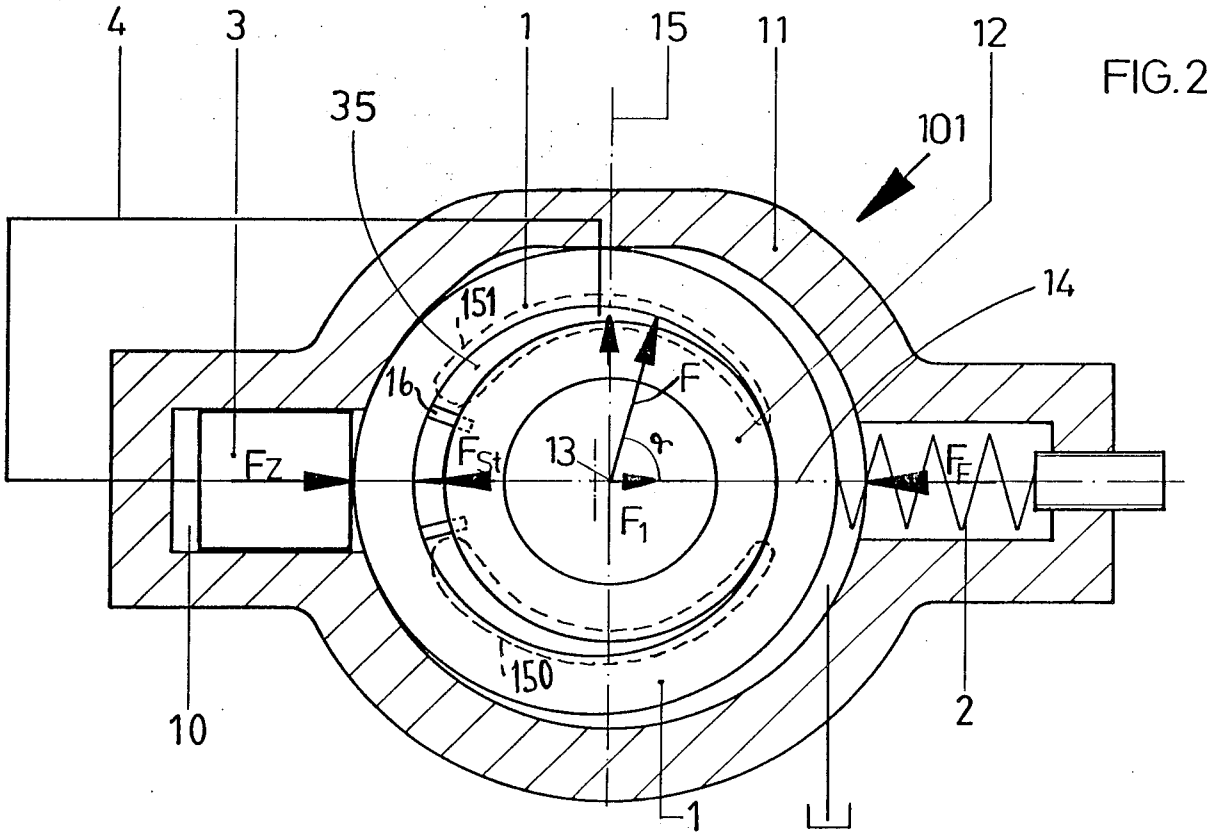
FIG. 2 represents a schematic cross sectional view of a directly actuated pressure regulated vane-type pump which discloses the basic concept of the invention.

The present invention is based on the recognition that the influence of the disturbing force $F_{St}$ can be reduced in its significance if an additional force $F_Z$ is generated which is proportional to the pressure and which acts against the disturbing force $F_{St}$. FIG. 2 discloses said general concept.

FIG. 2 discloses similarly to FIG. 1 a direct actuated pressure regulated vane-type pump 101. Again a housing 11, a rotor 12 and a cam ring 1 are shown. Further, spring means 2 are disclosed and the axes 13, 14 and 15 explained in connection with FIG. 1 are shown.

FIG. 2 also shows schematically the porting image of the pump, i.e. the inlet port 150 and the outlet 151.

In accordance with the invention the force $F_F$ exerted by spring means 2 can now be larger than in the prior art pump of FIG. 1 inasmuch as an adjustment piston 3 provides force $F_Z$ at the cam ring 1.

Said force $F_Z$ acts onto the cam ring at a point which is located diametrically with respect to the force $F_F$ of said spring means 2. The force $F_Z$ is generated by connecting the pressure chamber of the piston 3 via a conduit 4 with the pressure area or space 35 of pump 101. The pressure space 35 being defined by the outlet port 151 as explained above. Therefore, the system pressure or pump pressure will always be present at the plan surface of the adjustment piston 3 and, as a consequence, generates said additional force $F_Z$ which is proportional to the pressure. Due to this arrangement the above mentioned disadvantages of the prior art are overcome.

With reference to the additional FIGS. 2 to 8 additional embodiments of the invention will be described and for reasons of simplicity the same reference numerals will be used for components similar to the components already described with reference to FIGS. 1 and 2. It should be noted that FIG. 2 shows, between the two shown vanes 16 a change-over chamber, a chamber to which will be referred later.

The embodiment of FIG. 2 provides for a direct transfer of the force $F_Z$. This direct transfer causes friction which leads to a hysteresis or time lag of the flow vs. system pressure (Q/p)-curve or characteristic of the pump. Therefore, the following embodiments will provide means so as to achieve a transfer of the force from the adjustment piston 3 onto the cam ring 1 with little friction.

Figure 3:
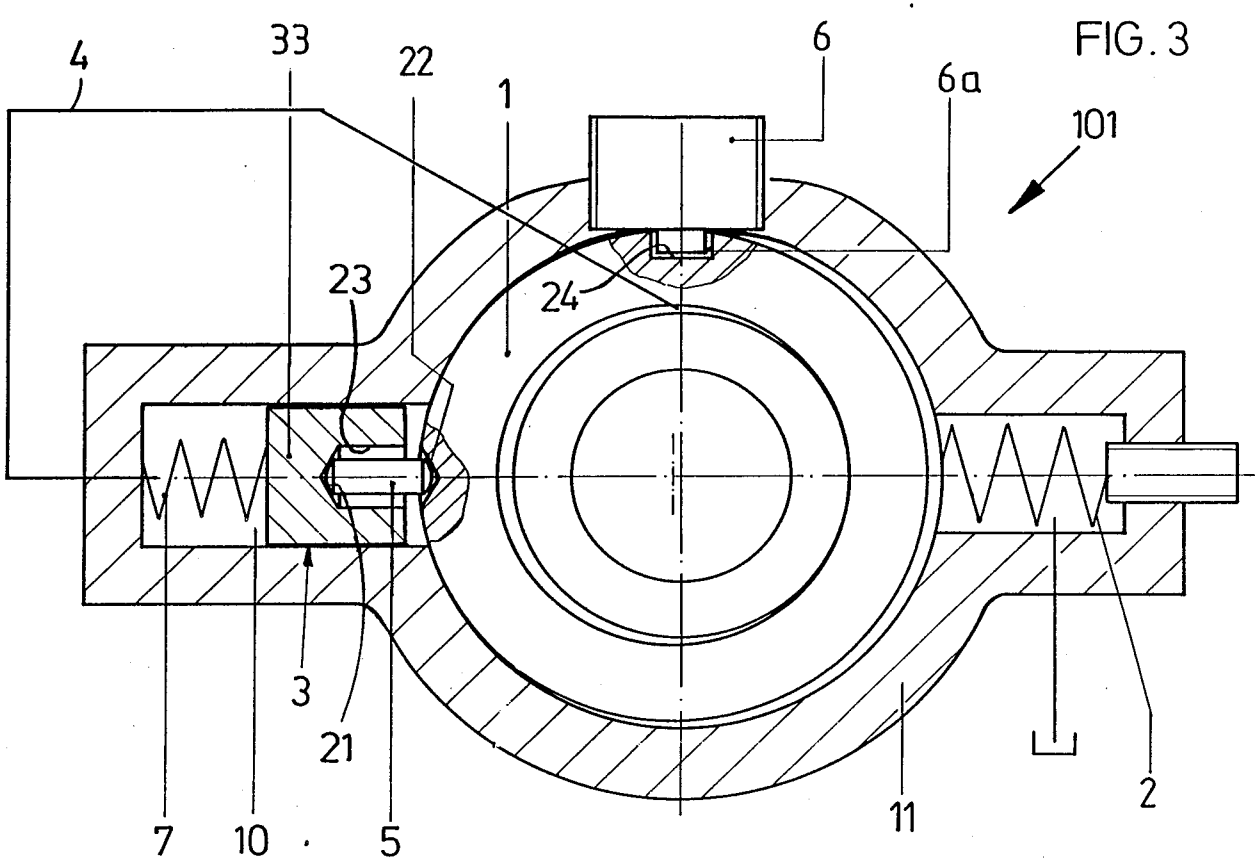
FIG. 3 represents a schematic cross sectional view of a second embodiment of the invention.

In accordance with the embodiment of FIG. 3 an intermediate member 5 is provided between the piston 33 and the cam ring 1; said intermediate member 5 being a pivot pin, for example, which can pivot relative to ring 1 and piston 33. Due to this intermediate member the friction between the piston 33 and the cam ring 1 is significantly reduced. The intermediate member 5 is placed in a bore 23 of the piston 33. The bore 23 ends in a cone shaped bearing suface 21 onto which the intermediate member 5 abutts with its one end. The pin shaped intermediate member 5 comprises two oppositely arranged curved ends. The other curved end of the intermediate member 5 also abuts at a cone shaped supporting or bearing surface 22, a surface 22 which is formed in the outer circumference of the cam ring 1. Spring means 7 located in the pressure space 10 are in abuttment with the piston 33 and provide for a bias of the intermediate or articulated member 5 all the time. The pressure space 10 of the piston 3 is again connected via a conduit 4 with the pressure space 35 of the pump 101 similarily to what is shown in FIG. 2.

A locking means 6 is provided and is in engagement with a bore 24 of the cam ring 1 so as to make the rotation of the cam ring 1 impossible. Said locking means 6 preferably has the form of a height adjustment screw as is known for pumps of this type.

Figure 4:
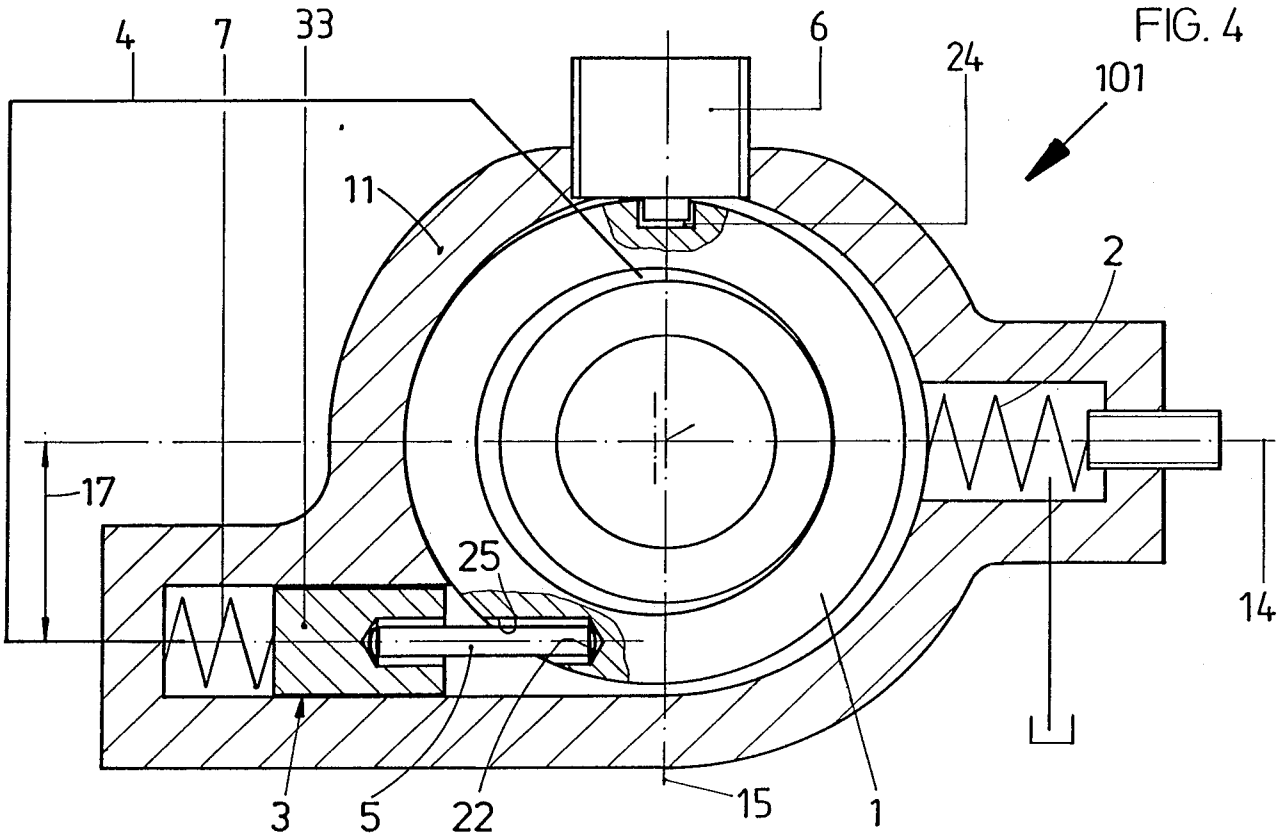
FIG. 4 represents a schematic cross sectional view of a third embodiment of the invention.

FIG. 4 discloses another embodiment of the invention according to which the space required for the arrangement comprising spring 7, piston 33 and intermediate member 5 is reduced with respect to the FIG. 3 embodiment. It should be noted that a piston 33 of FIG. 4 is offset with respect to the cross axis 14 by a distance 17. A bore 25 is provided in the cam ring and extends from the outer circumference of said cam ring towards the supporting surface 22 so as to allow access for the articulate or intermediate member 5.

Figure 5:
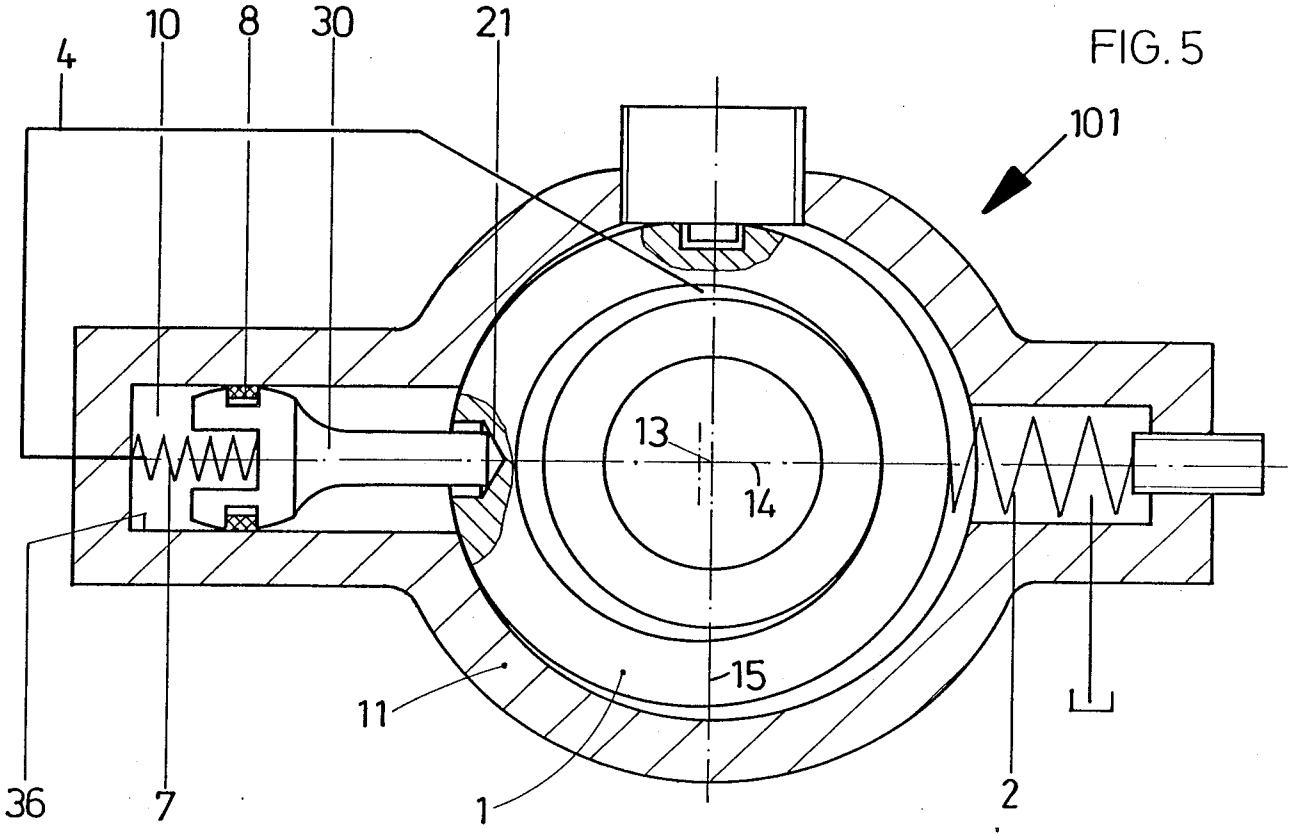
FIG. 5 represents a schematic cross sectional view of a fourth embodiment of the invention.

FIG. 5 discloses a still further embodiment of a pump 101 according to which a ball shaped piston 30 is used. The ball shaped piston 30 does include the intermediate member shown in FIGS. 3 and 4, i.e. the piston 30 is a one-piece design and comprises a ball-shaped part and a reduced diameter part, the latter of which corresponds to the intermediate member 5 of FIG. 3. The ball shaped or widened part of the piston 30 is guided in the pressure space 10 while the small diameter part is in abutment with the cone shaped supporting surface 21 provided in the cam ring 1. The sealing between the core 36 of the adjustment piston 30 can be provided in the form of a gap seal or by means of a piston ring 8 or by means of a not shown resilient seal.

It is also possible to arrange the piston 30 of FIG. 5 similarily to the arrangement of FIG. 4 at a lower level, an embodiment which is however not shown in the drawing.

Figure 6:
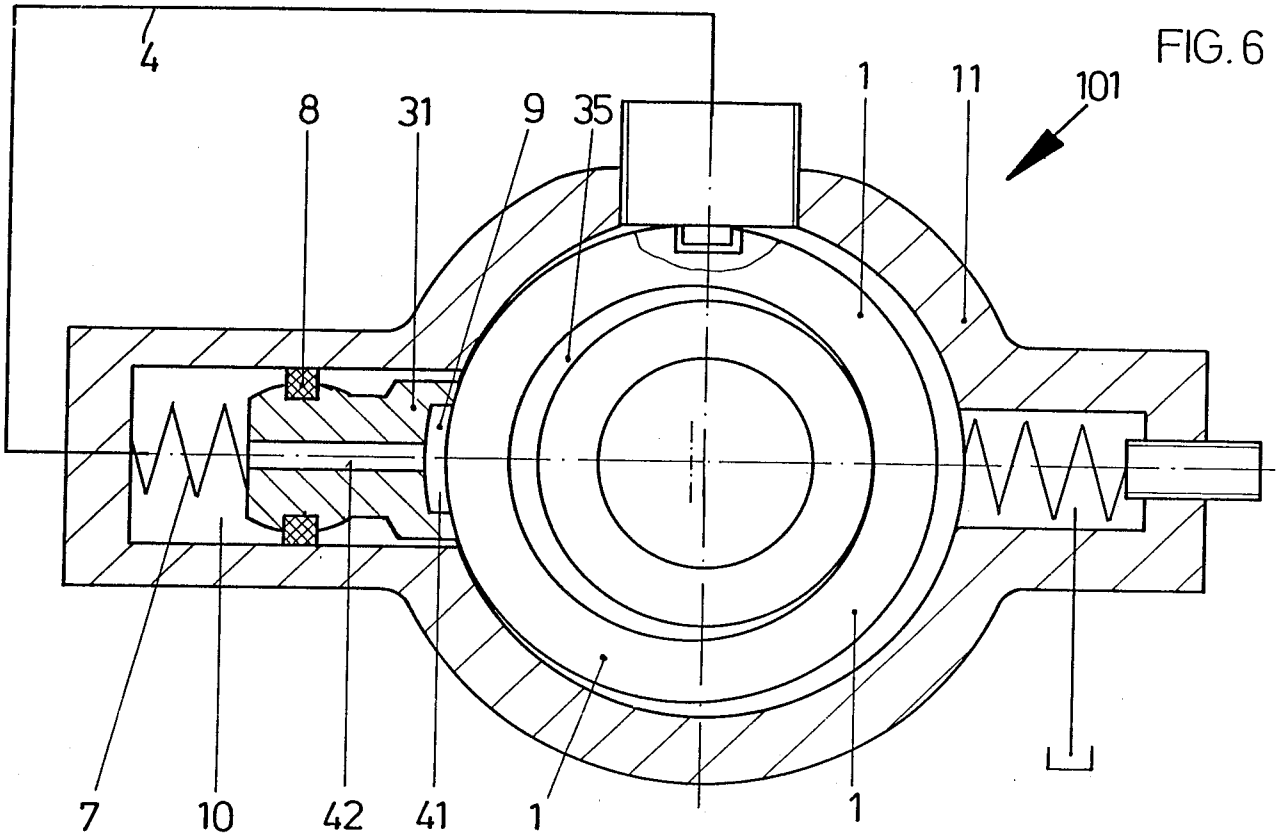
FIG. 6 represents a schematic cross sectional view of a fifth embodiment of the invention.

FIG. 6 discloses a still further embodiment of the invention according to which a hydrostatic pressure field 9 is used so as to reduce the friction between the adjustment piston 31 and the cam ring 1. The hydrostatic presure field 9 is supplied with oil of system pressure via a channel 42 in piston 31. Channel 42 connects the pressure space or chamber 10 with a recess 41 provided at the end of the piston 31 which faces towards the cam ring 1. A conduit 4 connects the pressure area 35 of the pump 101 with the pressure chamber 10 of the piston 31.

Figure 7:
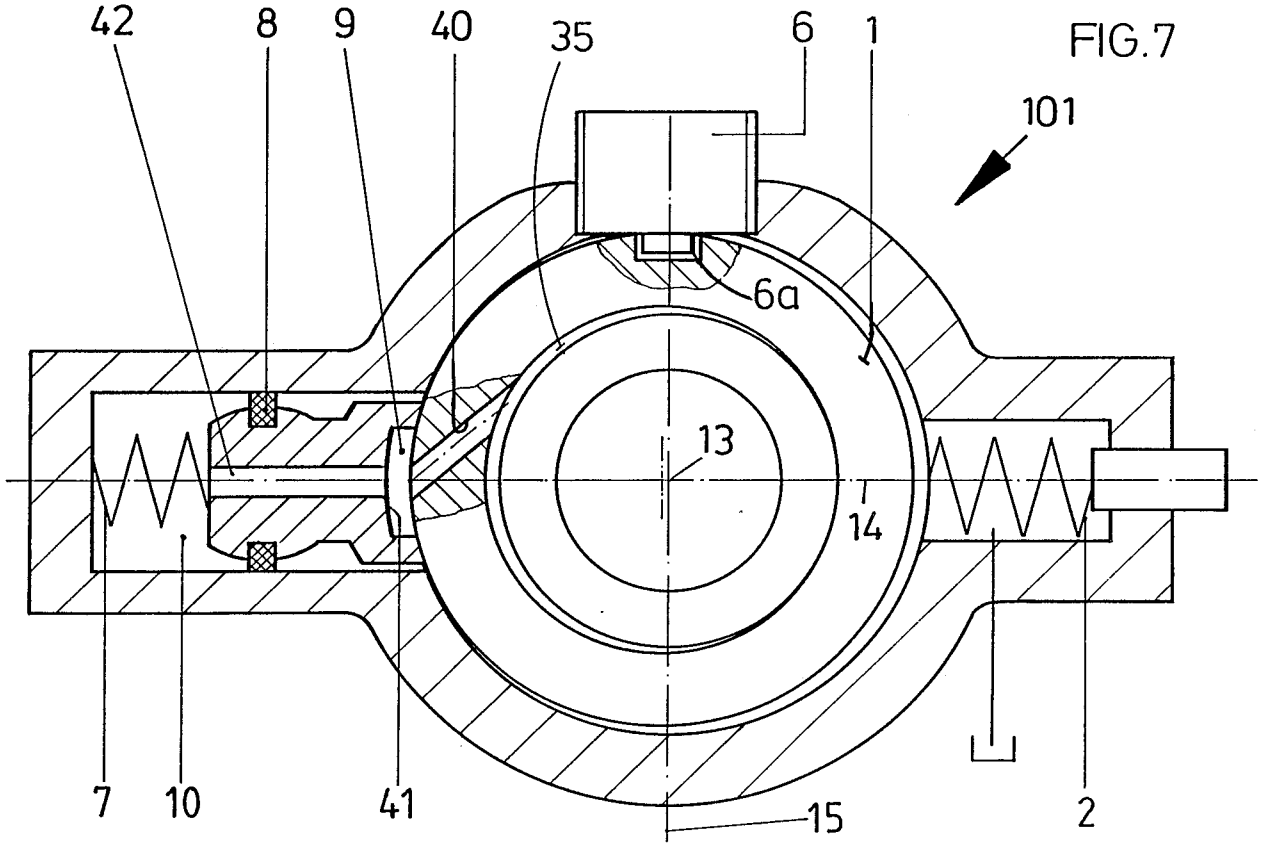
FIG. 7 represents a schematic cross sectional view of a sixth embodiment of the invention.

FIG. 7 discloses another embodiment of the invention according to which another possibility is disclosed for supplying the system or pump pressure to the hydrostatic pressure field 9. In accordance with FIG. 7 the system pressure is supplied to the pressure field 9 by means of a connecting passage 40 in the cam ring 1. The connecting passage 40 is connected on the one hand side with the pressure chamber 35 of the pump 101 and on the other hand with the pressure field 9. The passage 42 in the adjustment piston 31 supplies oil at system pressure to the pressure chamber 10. As was true for the preceeding embodiments shown in FIGS. 3 to 6, again a spring 7 is provided in the pressure chamber 10 and the sealing of the piston 31 is provided by means of a seal 8. Also, a locking means 6 is provided.

Figure 8:
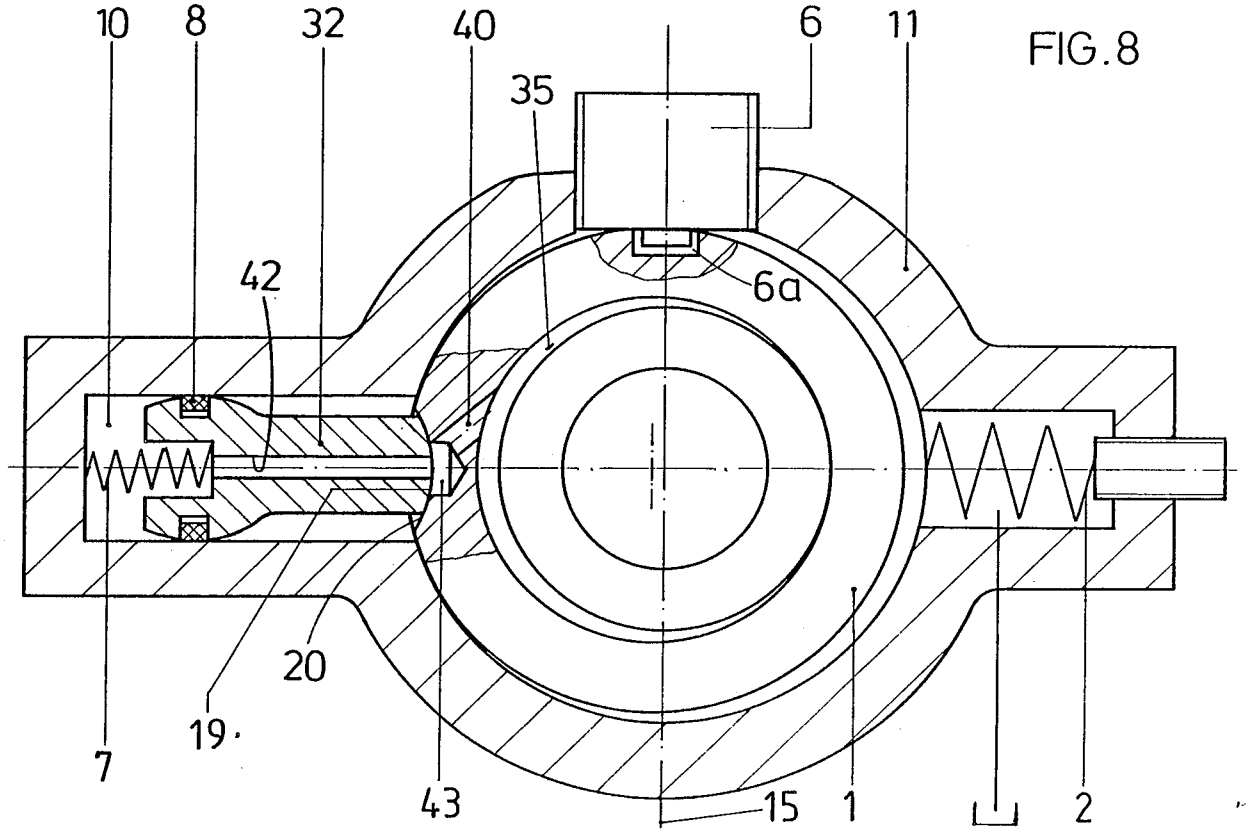
FIG. 8 represents a schematic cross sectional view of a seventh embodiment of the invention.

FIG. 8 discloses a last embodiment of the invention according to which an adjustment piston 32 is used which is spherically shaped at its end, the contacting end 19, engaging the cam ring 1. Due to the spherical shape of the contact end 19 a sealing engagement is provided with a spherical recess 20 of the cam ring 1. Similar to FIG. 7 a connecting passage 40 is provided between the pressure chamber 35 and a bore 43 in the cam ring 1. The pressure medium flows from said bore 43 via a channel 42 to the pressure chamber 10 of the piston 32.

Summarizing it may be said that the embodiment of FIG. 2 has a certain disadvantage with respect to the embodiments shown in FIGS. 3 to 8 in so far as during the adjustment operations a relatively high amount of friction occurs between the adjustment piston and the cam ring 1 which slides against said adjustment piston. More particularly, as the adjustment piston pushes against ring 1, ring 1 tends to pivot or roll at the point of contact adjacent the pump outlet and hence ring 1 slides relative to the adjustment piston at the point of contact therebetween. Friction at this point of contact resists movement of the ring toward a central position. This leads to a hysteresis or delayed response of the characteristic and consequently to a reduction of the reserve of stability. So as to avoid also this disadvantage the embodiments of FIGS. 3 to 8 provide for solutions in this respect.

In general terms the invention provides for a direct actuated pressure regulated vane-type pump having a adjustment piston which is under the influence of the pump pressure. The adjustment piston is coupled to said cam ring by means of a flexible or articulate connection means, or else the adjustment piston itself is of a flexible or articulate design.

We claim:

1. A directly actuated pressure regulating vane-type pump, comprising:

a housing, a cam ring mounted in said housing, a rotor carrying a plurality of vanes and rotatably supported by a shaft within said cam ring, spring means acting between said housing and said cam ring and tending to bias said cam ring into an eccentric initial position with a force $F_F$, whereby said spring means sets a full flow position of said cam ring, an adjustment piston applying a force $F_Z$ onto said cam ring, said force $F_Z$ acting diametrically opposite to said spring means, said adjustment piston being operatively coupled to the pump pressure, said cam ring being movable along the axis between said forces and also in a vertical plane through said axis, means for reducing friction between said piston and said cam ring, said means for reducing friction comprising means which can pivot to follow movement of said cam ring, inlet port means adapted to supply a pressure medium to said pump, outlet port means adapted to discharge pressure medium from said pump, said inlet port means and said outlet port means being disposed such that a force F generated by the pump pressure at the internal running surface of the cam ring forms with its horizontal component $F_1$, which acts against said spring means, an angle $\alpha$ of approximately 90°, and wherein said force $F_F$ of said spring means is substantialy larger than a disturbing force $F_{St}$ which acts on said cam ring, said force $F_{St}$ being primarily due to the precompression in the area of change-over between said inlet port means and said outlet port means.

2. The pump of claim 1, wherein said force $F_F$ of said spring means is about 30 to 70 times greater than the disturbing force $F_{St}$.

3. The pump of claim 1 wherein the adjustment piston is disposed in said housing and defines therewith a pressure chamber which is operatively coupled to the system pressure.

4. The pump of claim 1 wherein said adjustment piston is operatively coupled to a pressure chamber defined in said housing, said pressure chamber being connected to the system pressure of the pump by means of a passage defined in said housing.

5. The pump of claim 1, wherein a pivoting element is disposed between said piston and said cam ring.

6. The pump of claim 5, wherein said pivoting element is disposed in a bore of said piston, said bore terminating in a cone shaped supporting surface, said pivot pin element being rod shaped and having rounded first and second ends, one of said ends being in abuttment with said supporting surface, the other of said ends being in engagement with a cone shaped supporting surface in said cam ring.

7. The pump of claim 1, wherein said adjustment piston is biased by means of a spring means in a direction towards engagement with said cam ring.

8. The pump of claim 7, wherein said adjustment piston is disposed in said housing and defines therewith a pressure chamber, said spring means being disposed in said pressure chamber.

9. The pump of claim 1 further comprising a locking means for preventing rotation of said cam ring.

10. The pump of claim 9, wherein said locking means comprises a height adjustment screw.

11. The pump of claim 1 wherein said adjustment piston is offset a predetermined distance from a central axis of the pump.

12. The pump of claim 1 wherein said adjustment piston comprises a ball shaped piston.

13. The pump of claim 12 wherein said ball shaped piston is a sngle piece element and comprises a first, reduced diameter end which is in engagement with a cone shaped supporting surface of said cam ring, a second end of said adjustment piston being guided in a pressure chamber defined in said housing with at least one of a piston ring means and an elastic seal.

14. The pump of claim 1 wherein said means for reducing friction comprises a hydrostatic pressure field defined between said adjustment piston and said cam ring.

15. The pump of claim 14 wherein said hydrostatic pressure field is supplied with oil at system pressure by means of a passage defined in said piston.

16. The pump of claim 15 wherein said passage connects a pressure chamber defined between said piston and said housing with a recess defined at the end of said piston which faces said cam ring, and wherein a conduit connects a pressure chamber of the pump with the pressure chamber of the piston (31).

17. The pump of claim 14 wherein said hydrostatic pressure field is supplied with oil at system pressure by means of a connecting channel in said cam ring, said connecting channel communicating at one end thereof with a pressure chamber of the pump and at the other end thereof with said hydrostatic pressure field.

18. The pump of claim 13 wherein said adjustment piston is spherically shaped at the end thereof adjacent said cam ring, so as to sealingly engage a spherical recess of said cam ring.

19. A directly actuated pressure regulated vane-type pump comprising:

a housing, a cam ring mounted in said housing, a rotor carrying a plurality of vanes and rotatably supported by a shaft within said cam ring, first spring means acting between said housing and said cam ring and tending to bias said cam ring into an eccentric initial position, whereby said first spring means sets a full flow position of said cam ring, an adjustment piston applying a force onto said cam ring in a direction diametrically opposite to said first spring means, said adjustment piston being operatively coupled to the pump pressure, inlet port means in said housing and adapted to discharge pressure medium from said pump, said adjustment piston and said housing defining therebetween a pressure chamber, said pressure chamber being supplied with pump pressure via a passage in said cam ring, second spring means for biasing said adjustment piston towards engagement with said cam ring, said second spring means being arranged in said pressure chamber adjacent to said adjacent piston, and a hydrostatic pressure field defined between said adjustment piston and said cam ring so as to reduce friction between said adjustment piston and said cam ring, wherein said hydrostatic pressure field is supplied with a pressure medium at pump pressure by means of said passage in said cam ring.

* * * * *